US008752612B2

(12) United States Patent
Sato et al.

(10) Patent No.: US 8,752,612 B2
(45) Date of Patent: Jun. 17, 2014

(54) SET OF MEMBERS FOR AN EVAPORATIVE PATTERN AND AN EVAPORATIVE PATTERN

(75) Inventors: Masanori Sato, Toyota (JP); Masashi Takahashi, Toyota (JP); Mikine Katagiri, Toyota (JP); Akiji Kato, Toyota (JP); Sohei Mizutani, Toyota (JP); Kenichi Shichida, Toyota (JP); Tsuyoshi Nanba, Toyota (JP); Susumu Okabe, Toyota (JP); Isao Nojiri, Nisshin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/202,488

(22) PCT Filed: Jan. 28, 2011

(86) PCT No.: PCT/JP2011/051824

§ 371 (c)(1),
(2), (4) Date: Aug. 19, 2011

(87) PCT Pub. No.: WO2012/101828

PCT Pub. Date: Aug. 2, 2012

(65) Prior Publication Data

US 2013/0292082 A1 Nov. 7, 2013

(51) Int. Cl.
*B22C 7/02* (2006.01)

(52) U.S. Cl.
USPC ..... 164/249; 164/235

(58) Field of Classification Search
USPC ..... 164/45, 235, 245, 246, 249
See application file for complete search history.

(56) References Cited

U.S. PATENT DOCUMENTS

| | | | | |
|---|---|---|---|---|
| 2,991,520 | A | 7/1961 | Dalton | |
| 4,724,889 | A | 2/1988 | McPherson et al. | |
| 5,291,938 | A * | 3/1994 | Metevelis et al. | 164/359 |
| 2003/0098136 | A1 * | 5/2003 | Ludwig et al. | 164/35 |
| 2007/0044936 | A1 * | 3/2007 | Memmen | 164/45 |
| 2013/0025815 | A1 * | 1/2013 | Nibouar et al. | 164/271 |

(Continued)

FOREIGN PATENT DOCUMENTS

| | | |
|---|---|---|
| CN | 102844129 A | 12/2012 |
| JP | A-61-266147 | 11/1986 |

(Continued)

OTHER PUBLICATIONS

Nov. 27, 2013 Office Action issued in U.S. Appl. No. 13/202,458.

*Primary Examiner* — Kevin P Kerns
(74) *Attorney, Agent, or Firm* — Oliff PLC

(57) ABSTRACT

A lightweight metal mold having a necessary hardness is realized. A plurality of bar-shaped members formed of an evaporative material and a plurality of connecting members formed of an evaporative material are prepared. Each of the connecting members has a spherical shape, and ends of a plurality of the bar-shaped members can be connected to each connecting member. Since a fixing angle of each bar-shaped member with respect to the connecting member can be adjusted freely, a three-dimensional mesh structure having various shapes can be formed. By combining the plurality of bar-shaped members and the plurality of connecting members, an evaporative pattern including the three-dimensional mesh structure can be assembled. By adjusting the shape of the three-dimensional mesh structure, the hardness necessary for the metal mold can be obtained, and the metal mold can be made lighter.

9 Claims, 7 Drawing Sheets

(56) References Cited

U.S. PATENT DOCUMENTS

| | | | | |
|---|---|---|---|---|
| 2013/0139990 | A1* | 6/2013 | Appleby et al. | 164/47 |
| 2013/0255351 | A1 | 10/2013 | Nanba et al. | |
| 2013/0295316 | A1 | 11/2013 | Sato et al. | |

FOREIGN PATENT DOCUMENTS

| | | |
|---|---|---|
| JP | A-2-192844 | 7/1990 |
| JP | A-7-323400 | 12/1995 |
| JP | A-8-1275 | 1/1996 |
| JP | A-2007-260750 | 10/2007 |
| JP | A-2010-112533 | 5/2010 |
| JP | B1-4553271 | 7/2010 |
| JP | A-2011-051824 | 3/2011 |
| JP | A-2011-240351 | 12/2011 |
| WO | WO 00/15370 | 3/2000 |

* cited by examiner

SET OF MEMBERS FOR AN EVAPORATIVE PATTERN AND AN EVAPORATIVE PATTERN

TECHNICAL FIELD

The present invention relates to an evaporative pattern that is used in full-mold casting, and a set of members that form the evaporative pattern.

BACKGROUND ART

Full-mold casting is one known method of forming metal products. In full-mold casting, a pattern is prepared that has the same shape as the metal product to be formed. The pattern is formed from a material that evaporates when it comes into contact with molten metal. When the evaporative pattern is packed inside a sand mold and molten metal is poured into the sand mold, the pattern will evaporate and be replaced with the molten metal. When the sand mold is destroyed after the molten metal has cooled, a cast product having the same shape as the pattern will be obtained.

Although full-mold casting is an excellent method for forming metal products having complex shapes, one problem is that it is difficult to fill the powder material that forms the sand mold around the evaporative pattern. In general, metal molds have complex shapes, therefore, the evaporative patterns for the metal molds have complex shapes. Cavities are easily formed around an evaporative pattern having a complex shape (i.e., spaces that are not filled with the powder material are left around the evaporative pattern) when the evaporative pattern is packed in a sand mold. Thus, difficult work will need to be continued over a long period of time in order to form a good sand mold.

A standard metal mold is formed by machining a metal blank, and comprises a mold surface that comes into contact with a work piece, and a positioning surface that contacts the other side of the metal mold and adjusts the positional relationship with the other side of the metal mold. The metal blank on the back sides of the mold surface and the positioning surface plays a role in providing the mold surface, providing the positioning surface, and fixing the relative positional relationship between the mold surface and the positioning surface. Here, the portion that fixes the relative positional relationship between the mold surface and the positioning surface need not be a metal blank.

Patent Reference 1 discloses a metal mold that reinforces the lower die made of a plate with a lower frame, and reinforces the upper die made of a plate with an upper frame. The upper frame and lower frame used here are comprised of a plurality of bar-shaped members, as well as a three-dimensional mesh structure having connecting points that link the ends of the bar-shaped members and are distributed inside a three-dimensional space. By using a three-dimensional mesh structure instead of a metal blank, a product capable of being used as a metal mold can be achieved.

PRIOR ART REFERENCE

Patent Reference

Patent Reference 1: Japan Published Unexamined Patent Application No. 7-323400

With a metal mold having a portion of the metal blank replaced with a three-dimensional mesh structure, the task of filling the powder material around the evaporative pattern for forming the metal mold will be simplified. A metal mold in which a portion thereof is replaced with a three-dimensional mesh structure will be easy to form with full-mold casting. In addition, a metal mold in which a portion thereof is replaced with a three-dimensional mesh structure will also have advantages, such as being lightweight, the rigidity thereof can be easily adjusted, and the heat radiation characteristics thereof can be easily adjusted. The present inventors have discovered the advantages of a metal mold in which a portion thereof is replaced with a three-dimensional mesh structure, have discovered the good compatibility between that metal mold and full-mold casting, and are conducting research on technology for forming that metal mold by means of full-mold casting in which a portion of the evaporative pattern is replaced with a three-dimensional mesh structure.

SUMMARY OF INVENTION

Technical Problem

As a result of this research, it became clear that technology for simplifying the process of forming an evaporative pattern was needed. Three-dimensional mesh structures are not only those formed by repeating units of structure at regular intervals, but also include mesh structures in which the angles between the plurality of bar-shaped members are changed depending on location. In order to realize this type of mesh structure, the angles between the bar-shaped members must be freely adjusted during the task of connecting the bar-shaped members.

A set of members which achieves a three-dimensional mesh structure by connecting the ends of the bar-shaped members is known. For example, building block sets are known which are constructed from a plurality of bar-shaped members and a plurality of connecting members. As illustrated in FIG. 10, when the connecting member 40*b* is a regular hexahedron, a hole is formed in each of the six sides for inserting the ends of bar-shaped members 40*a*1- 40*a*6. If this set of building blocks is used, 12 bar-shaped members can be fixed on the 12 edges that form a cube by using 12 bar-shaped members and 4 connecting members. If this set of building blocks is used, cubes can form units, and a three-dimensional mesh structure can be formed by combining a plurality of cube units. FIG. 9 illustrates another example of bar-shaped members and connecting members, in which tubular bar-shaped members can be used to form a three-dimensional mesh structure. In addition, sets of members used for building crystalline structures such as hexagonal crystals, steric structures such as organic molecules, or the helical structure of DNA are also known.

However, with prior art sets of members, the angle between the bar-shaped members is limited to a predetermined angle, and thus the angle between the bar-shaped members cannot be freely adjusted to a desired angle. As shown in FIG. 10, when the connecting members are cubes, the angles between the bar-shaped members are limited to 90 degrees or 180 degrees, and cannot be placed in other angles. In the case of FIG. 9, by adjusting the direction at which the receiving portions extend in a straight line from the center of the connecting member, the angle between the bar-shaped members can be established. However, because the angle between the bar-shaped members is established by the direction in which the receiving portions extend, it cannot be adjusted to another angle.

The present invention relates to a set of members for assembling an evaporative pattern to be used in a full-mold casting, and provides a set of members that can freely adjust and fix the angle between bar-shaped members.

Solution to Technical Problem

The present invention provides a set of members comprising a plurality of bar-shaped members formed of an evaporative material, and a plurality of connecting members formed of an evaporative material. Each of the connecting members has a substantially spherical shape. Because of this, the ends of a plurality of the bar-shaped members can be fixed to one connecting member. The ends of the plurality of bar-shaped members can be connected by the connecting member, and a three-dimensional mesh structure can be achieved. Moreover, the fixing angle of each bar-shaped member with respect to the connecting member can be adjusted freely. The angle between the bar-shaped members can be freely adjusted and fixed. A mesh structure can be achieved in which the angle between the bar-shaped members changes according to location. A set of members that can achieve a mesh structure of various shapes will be obtained.

It is preferable that projections that lodge in the connecting member be formed on the end of each bar-shaped member. By lodging projections formed in the ends of the bar-shaped members into the connecting member, the fixing angle of the bar-shaped members with respect to the connecting member, and the angle between the bar-shaped members, can be maintained at the desired angle. When the connecting member is fixed with adhesive or the like to the bar-shaped members, the adjusted angle can be prevented from slipping.

When the aforementioned set of members is used, an evaporative pattern can be constructed of a plurality of bar-shaped members formed with an evaporative material and a plurality of connecting members formed with an evaporative material, the end portions of the plurality of bar-shaped members being fixed to one connecting member to form a three-dimensional mesh structure, and each connecting member having an almost spherical shape. Although there are cases in which the entire evaporative pattern is formed with the aforementioned set of members, there may also be cases in which the entire evaporative pattern is completed by adding other members to this set.

DESCRIPTION OF EMBODIMENTS

Figure 1:
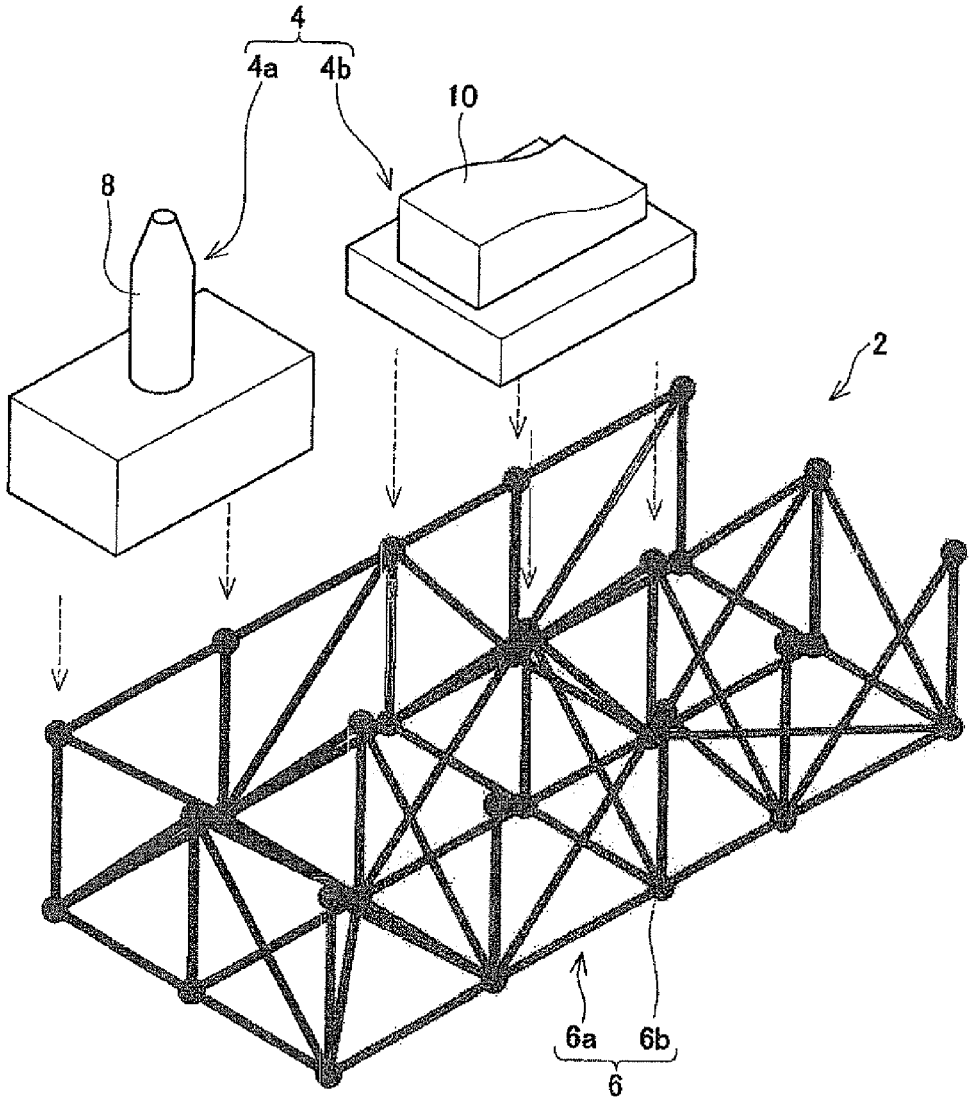
FIG. 1 shows a perspective view of a portion of an evaporative pattern used in full-mold casting.

FIG. 1 shows a perspective view of a portion of an evaporative pattern 2 in which a portion thereof is formed with a three-dimensional mesh structure 6. FIG. 1 shows blocks 4*a*, 4*b* separated from the three-dimensional structure 6, but in fact the blocks 4*a*, 4*b* are fixed to the three-dimensional mesh structure 6, and the relative positional relationship of the blocks 4*a*, 4*b* is fixed in a defined positional relationship by the three-dimensional mesh structure 6. In addition, additional blocks may also be fixed to the three-dimensional structure 6.

The three-dimensional mesh structure 6 is formed by assembling together a plurality of bar-shaped members 6*a* and a plurality of connecting members 6*b*. Each of the bar-shaped members 6*a* is formed from a material that evaporates when it comes into contact with molten metal, e.g., polystyrene foam, paper, or the like. Each of the bar-shaped members 6*a* may be hollow (i.e., tubular), or may be solid. Both ends of the tube may be closed with an evaporative cap. Each of the connecting members 6*b* is formed from a material that evaporates when it comes into contact with molten metal, e.g., polystyrene foam, paper, or the like. Each of the connecting members 6*b* may be hollow, or may be solid. As shown in FIG. 1, the ends of the plurality of bar-shaped members 6*a* are fixed to one connecting member 6*b*. Adjacent bar-shaped members are fixed together via a connecting member. The angle between bar-shaped members is regulated by the fixing angle of the bar-shaped members with respect to the connecting member.

The blocks 4*a*, 4*b* are formed by machining a block of polystyrene foam. With the present embodiment, a machined surface 10 is formed on the block 4*b*, a guide pin 8 is formed on the block 4*a*, and a positioning hole in which the guide pin 8 is inserted is formed in a block 4*c* that is not illustrated. The block 4*a*, 4*b* (and the block 4*c* not illustrated) are adhered to the three-dimensional structure by means of an adhesive. In FIG. 1, although the blocks 4*a*, 4*b*, etc.

are adhered to the connecting member 6*b*, they may be adhered to the bar-shaped members 6*a*.

An actual mesh structure 6, as shown in FIG. 1, may have some of the bar-shaped members removed, or may have additions added to some of the bar-shaped members. The three-dimensional structure 6 will be a truss structure or a Rahman structure. It may also have a mixture of truss and Rahman structures. The arranged positions of the connecting member 6*b* need not be uniformly distributed, and if some positions are arranged densely, then other positions will be arranged sparsely. In other words, the angle between bar-shaped members will differ depending on location. Note that the bar-shaped members are not necessarily straight, and curved bar-shaped members may also be used.

When the evaporative pattern 2 is used to perform full-mold casting, a cast product will be obtained that has the same shape as the evaporative pattern. 2. In the present embodiment, this cast product is used in as metal mold 3 for pressing, In the present embodiment, the bar-shaped parts are distinct from the bar-shaped members. The bar-shaped parts are portions that form a part of a large object and have a bar shape. The bar-shaped members are independent members that are bar-shaped. The relationship between connecting parts and connecting members, between block parts and block members, and between tubular part and tubular members are same. The evaporative pattern has bar-shaped members and connecting members. The cast product is integral, therefore, has bar-shaped parts and connecting parts. In the cast product, there are no longer members.

Figure 2:
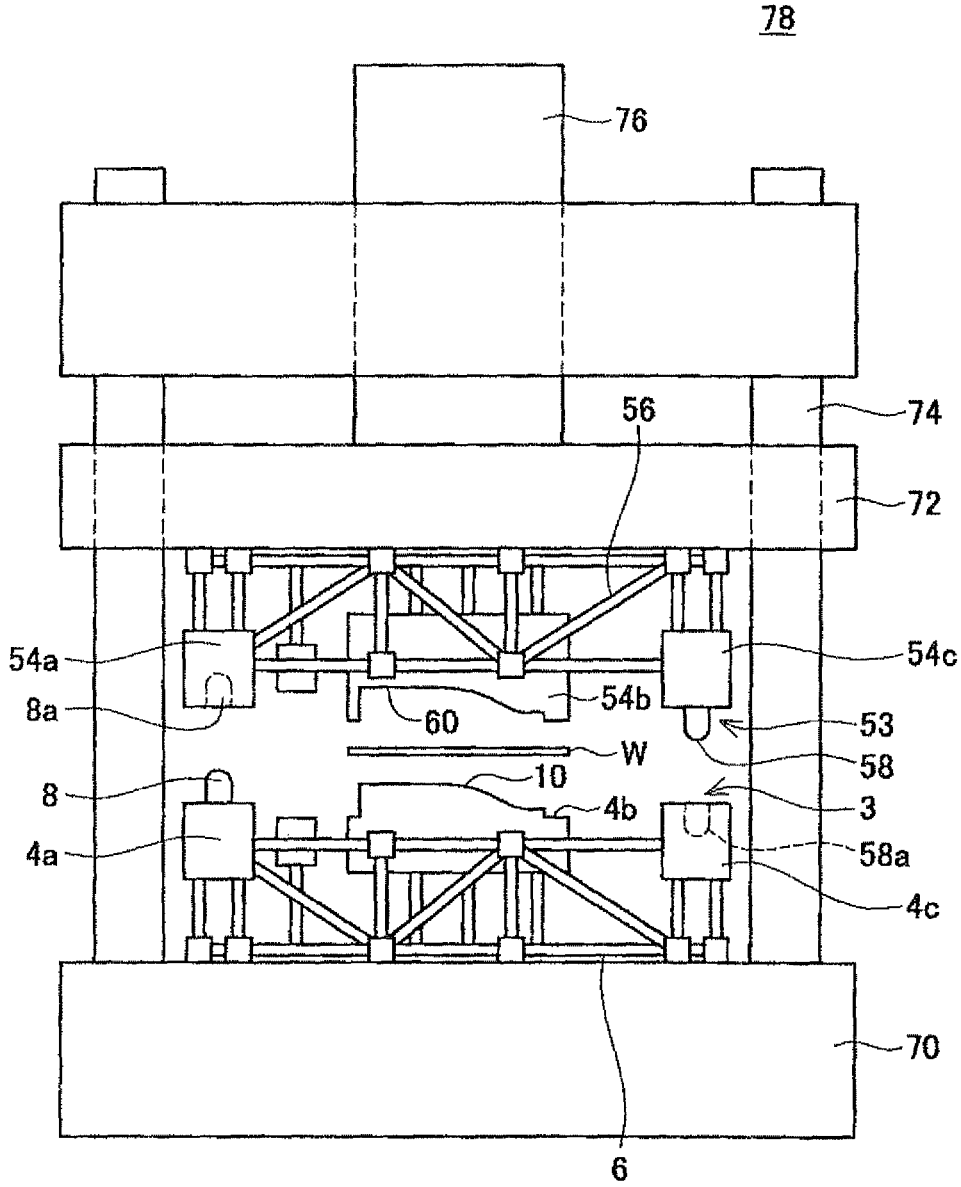
FIG. 2 shows a metal mold set into a press. A part of the metal mold is formed with a three-dimensional mesh structure.
Figure 3:
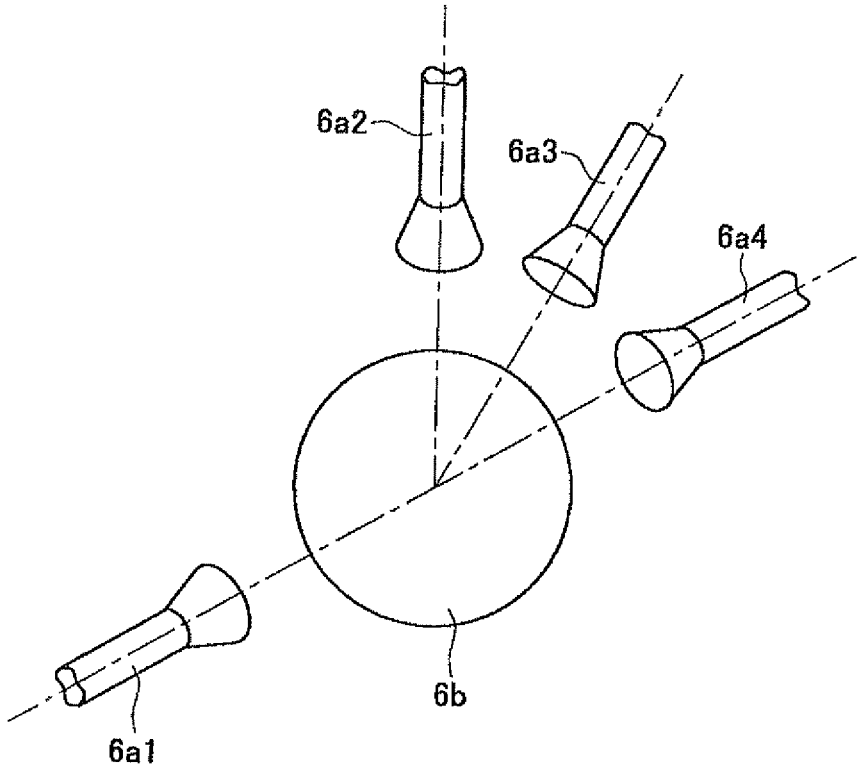
FIG. 3 shows the ends of a plurality of bar-shaped members fixed to a connecting member having a spherical shape.

FIG. 2 shows a metal mold 3 for pressing that was cast by full-mold casting and fixed to a bolster 70 of a press 78, and a metal mold 53 for pressing that was also cast by the full-mold casting and fixed to a slider 72 of the press 78. Note that 74 in the drawing is a slide guide for the press 78, and 76 is an actuator for the press 78. When the actuator 76 operates, the slider 72 drops downward along the slide guide 74. When this occurs, the guide pin 8 of the metal mold 3 will be inserted into a positioning hole 8*a* of the metal mold 53, a guide pin 58 of the metal mold 53 will be inserted into a positioning hole 58*a* of the metal mold 3, and the relative positional relationship between the metal mold 3 and the metal mold 53 will be positioned in a prescribed positional relationship. The block 4*a*, the guide pin 8, the block 4*b*, the machined surface 10, etc. of FIG. 1 are portions of the evaporative pattern, and formed with polystyrene foam. In contrast, the block 4*a*, the guide pin 8, the block 4*b*, the machined surface 10, etc. of FIG. 3 are portions of the metal mold 3, and formed with cast metal. Although the same reference numerals are used for the sake of convenience, they are in fact different members. Because they are shown as having the same shape, the same reference numerals are used for the sake of convenience.

In the metal mold 3, the blocks 4*a*, 4*c* are fixed with respect to the block 4*b* by means of the mesh structure 6. Likewise in the metal mold 53, the blocks 54*a*, 54*c* are fixed with respect to the block 54*b* by means of a mesh structure 56. If the block 4*a* and the block 54*a* are positioned in a prescribed positional relationship, and the block 4*c* and the block 54*c* are positioned in a prescribed positional relationship, the block 4*b* and the block 54*b* will also be positioned in a prescribed positional relationship. As a result, the machined surface 10 of the metal mold 3 and a machined surface 60 of the metal mold 53 will also be positioned in a prescribed positional relationship. When the slider 72 drops down, the work piece W will be sandwiched between the machined surface 10 of the metal mold 3 and the machined surface 60 of the metal mold 53, and will be pressed into a prescribed shape.

The metal mold 3 comprises a structure in which the blocks 4*a*, 4*c* for positioning and the block 4*b* for machining are fixed to the three-dimensional mesh structure 6. The metal mold 3 is lightweight because the portion that fixes the positional relationship of the blocks is the three-dimensional mesh structure 6 and not a metal block. In addition, the blocks can be connected with an appropriate amount of rigidity because the positional relationship of the blocks is prescribed by the three-dimensional mesh structure 6. For example, the rigidity between the blocks can be adjusted to be stiff such that when the block 4*a* and the block 54*a* are positioned in a prescribed positional relationship, and the block 4*c* and the block 54*c* are positioned in a prescribed positional relationship, the block 4*b* and the block 54*b* are also positioned in a prescribed positional relationship. At the same time, the rigidity between the blocks can be adjusted to be flexible such that when the machined surface 10 of the block 4*b* and the machined surface 60 of the block 54*b* are slightly tilted at the prescribed positional relationship and a localized range of the machined surface 10 and the machined surface 60 press strongly on the work piece W, the block 4*b* and the block 54*b* can be rotated relative to each other due to the localized reaction force and the machined surface 10 and the machined surface 60 uniformly press on the work piece W.

In addition, the evaporative pattern 2 comprising the blocks 4*a*, 4*b*, 4*c* and the mesh structure 6 can be easily packed in a sand mold, and it will be difficult for spaces to remain around it. It has good compatibility with full-mold casting. The task of packing sand around the evaporative pattern 2 can be performed relatively easily and completed in a short period of time, and a good quality sand mold can be obtained which is filled with powder material around the evaporative pattern 2 without gaps and with a uniform density. Details on and advantages of full-mold casting performed by using an evaporative pattern constructed of a plurality of blocks and a three-dimensional mesh structure are disclosed in the specification and drawings of Japan Patent Application No. 2010-112533. Note that redundant disclosure therefrom has been omitted.

FIG. 3 shows an enlargement of the area around the ends of the plurality of bar-shaped members 6*a*1-6*a*4 that connect to the connecting member 6*b*. The connecting member 6*b* has a size that allows the end surfaces of a plurality of bar-shaped members to be fixed thereto. In addition, the connecting member 6*b* is formed into a substantially spherical shape, and the bar-shaped members can be fixed thereto at any angle. Thus, for example the angle between the bar-shaped members 6*a*1 and 6*a*2 can be set to any angle, and that angle can be fixed.

Figure 4:
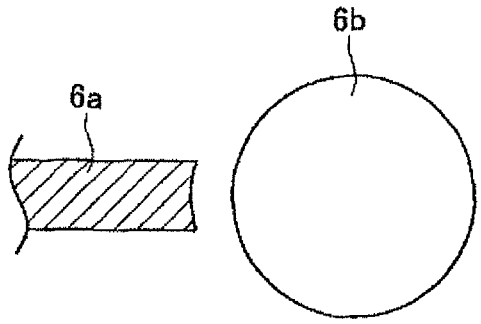
FIG. 4 shows a first example of a connecting member having a spherical shape and the shape of the end of a bar-shaped member.

FIG. 4 shows an example of the shape of the end of the bar-shaped members 6*a* that connects to the connecting member 6*b*. The bar-shaped member 6*a* may have a straight bar shape and an end surface that comports with the connecting member 6*b*.

Figure 5:
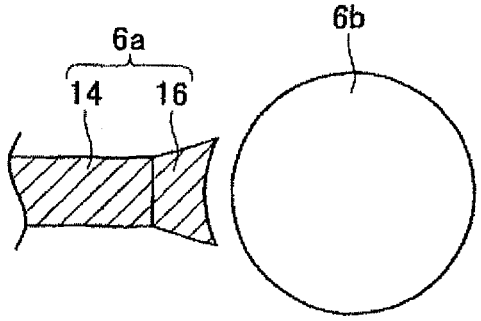
FIG. 5 shows a second example of a connecting member having a spherical shape and the shape of the end of a bar-shaped member.

FIG. 5 shows an example in which the bar-shaped member 6*a* are formed with a straight central portion 14 and an end portion 16 that expands toward the connecting member 6*b*. When comprised of an end portion 16 that expands toward the connecting member 6*b*, the adhesive strength between the bar-shaped members 6*a* and the connecting member 6*b* will be increased, and the concentration of stress can be mitigated.

Figure 6:
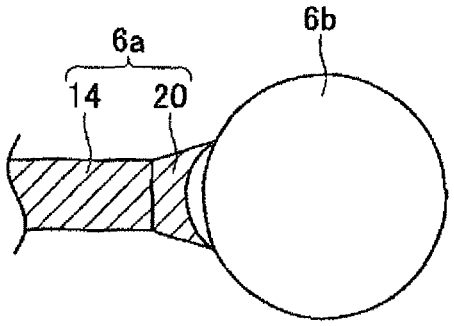
FIG. 6 shows a third example of a connecting member having a spherical shape and the shape of the end of a bar-shaped member.

FIG. 6 shows an example of a space that is preserved between the end surface of the end portion 20 and the spherically shaped connecting member 6*b*. This space can be used to allow an adhesive to harden. When the end surfaces of the bar-shaped members 6*a* are formed into a shape in which the bar-shaped members 6*a* are in direct contact with and fixed to the connecting member 6*b*, the positional relationship between the bar-shaped members 6*a* and the connecting member 6*b* can be stabilized after being adhered, and an evaporative pattern having a high degree of precision can be formed.

Figure 7A:
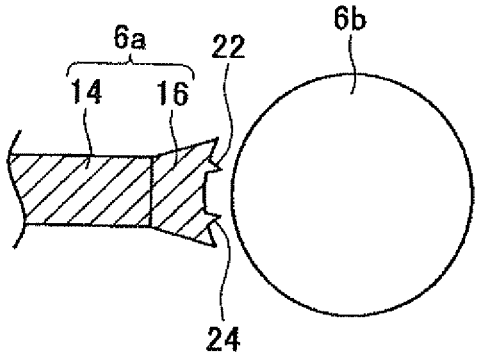
FIG. 7A shows a fourth example of a spherically shaped connecting member prior to being fixed to a bar-shaped member.
Figure 7B:
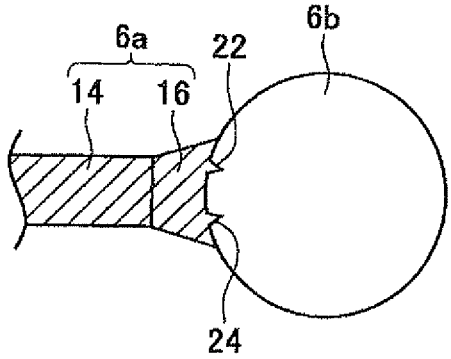
FIG. 7B shows the fourth example of a spherically shaped connecting member after being fixed to a bar-shaped member.

FIG. 7 shows an example in which projections 22, 24 are formed on the end of the end portion 16 of FIG. 5. As shown in FIG. 7B, the projections 22, 24 and the connecting member 6*b* are formed with a material and shape so that the projections 22, 24 will lodge into the connecting member 6*b* when the ends of the bar-shaped members 6*a* are pushed into the connecting member 6*b*. When the projections 22, 24 are lodged into the connecting member 6*b* in a state in which the fixing angle of the bar-shaped members 6*a*, with respect to the connecting member 6*b*, and the angles between the bar-shaped members are adjusted to the desired angles, slippage from the adjusted angles can be prevented while the adhesive that adheres the connecting member to the bar-shaped members hardens.

Figure 8A:
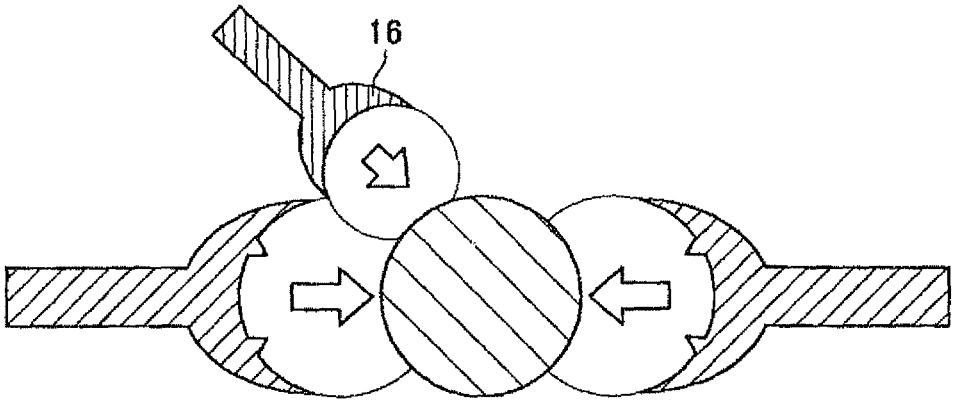
FIG. 8A shows a fifth example of a spherically shaped connecting member prior to being fixed to bar-shaped members.
Figure 8B:
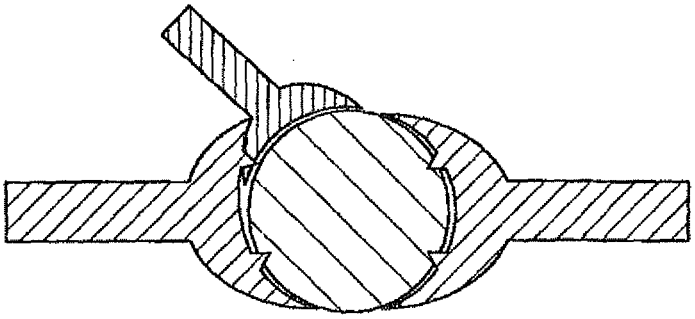
FIG. 8B shows the fifth example of a spherically shaped connecting member after being fixed to bar-shaped members.
Figure 9:
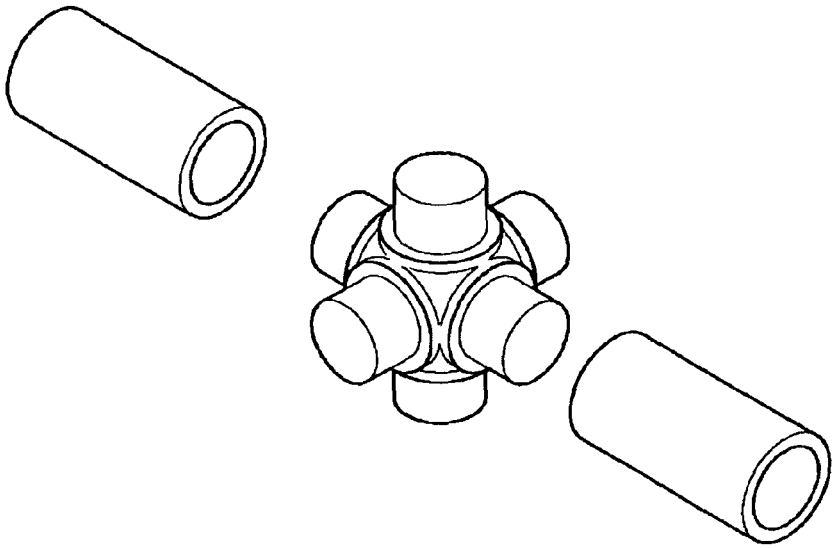
FIG. 9 Prior Art
FIG. 9 shows a first example of a conventional connecting member and bar-shaped members.
Figure 10:
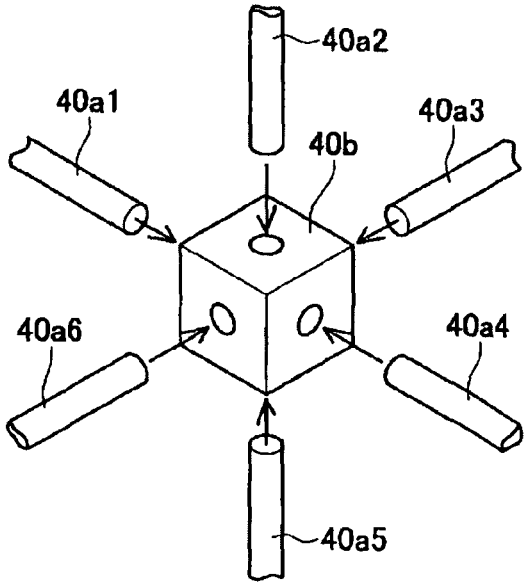
FIG. 10 Prior Art
FIG. 10 shows a second example of a conventional connecting member and bar-shaped members.

FIG. 8 shows an example of the outer surface of the end portion 16 formed into a partial spherical shape. Although it cannot be formed into a completely spherical shape in this situation, it can be formed into a shape that resembles a sphere. When the outer surface of the end portion 16 is formed into a quasi-spherical shape, another bar-shaped member can be fixed to the outer side thereof. A small relationship between the angles of the bar-shaped members can be obtained while using the end portion to increase the adhesive strength between the bar-shaped members and the connecting member.

In the present embodiments, the connecting member 6*b* is formed with a solid piece of polystyrene foam. The bar-shaped members 6*a* can also be formed with a solid piece of polystyrene. In the alternative, the bar-shaped members 6*a* may be formed with a paper pipe. In the present embodiments, both ends of the paper pipe are closed with polystyrene caps. When an evaporative pattern having a paper pipe is used to perform full-mold casting, the paper pipe will be carbonized by the heat of the molten metal, and when the cast metal product is taken out of the sand mold, the carbonized paper pipe will be removed. Instead of a paper tube that evaporates, a tube member that does not evaporate may also be used. For example, a tube member produced from steel used in metal molds may be used. In this situation, the tube member will remain even after full-mold casting has been performed, and a composite cast product filled with solidified cast metal in the interior thereof will be obtained. A composite cast product can also be obtained in which the quality of the material changes depending on the site. When non-evaporative tube members are used in regions in which a pattern is formed, gas will not be generated when the pattern evaporates, and molten metal will easily pass through the interior of the tube members. When an evaporative tube member is replaced with a non-evaporative one, the quality of the cast metal product can be prevented from declining.

Specific embodiments of the present invention are described above, but are mere illustrations and do not restrict the claims. The art set forth in the claims includes variations and modifications of the specific examples set forth above. The technological components described in the present specification or the drawings exhibit technological utility individually or in various combinations, and are not limited to the combinations disclosed in the claims at the time of application. In addition, the technology illustrated in the present specification or the drawings simultaneously achieve a plurality of objects, and achieving one object from amongst these has technological utility in and of itself.

Reference Signs List

2: Evaporative pattern
4: Block
6: Three-dimensional mesh structure
6*a*: Bar-shaped member
6*b*: Connecting member
8: Guide pin
10: Machined surface

The invention claimed is:

1. A set of members for assembling an evaporative pattern in the shape of a three-dimensional mesh structure to be used in a full-mold casting, the set of members comprising:

a plurality of bar-shaped members formed of an evaporative material; and a plurality of connecting members formed of an evaporative material, wherein each connecting member has a spherical shape, each end of each bar-shaped member is connected to each connecting member, and a fixing angle of each bar-shaped member with respect to the connecting member can be adjusted freely.

2. The set of members of claim 1, wherein at least one projection that lodges into the connecting member is formed at each end of each bar-shaped member.

3. The set of members of claim 1, wherein at least one end of each bar-shaped member expands towards a surface of at least one connecting member.

4. The evaporative pattern of claim 3, wherein a space is preserved between at least one end of each bar-shaped member and the surface of at least one connecting member in response to the at least one end of each bar-shaped member being in contact with the surface of at least one contacting member.

5. The evaporative pattern of claim 4, wherein an adhesive is filled in the space.

6. An evaporative pattern in the shape of a three-dimensional mesh structure to be used in a full-mold casting, the evaporative pttern comprising:

an assembly of a plurality of bar-shapedmembers formed of an evaporative material and a plurality of connecting members formed of an evaporative material;

each connecting member havinga spherical shape; and one end of each bar-shaped member being connected to one of the connecting members and another end of each bar-shaped member being connected to another connecting member to form the three-dimensional mesh structure, wherein a fixing angle of each bar-shaped member with respect to the connecting member can be adjusted freely.

7. An evaporative pattern in the shape of a three-dimensional mesh structure to be used in a full-mold casting, the evaporative pattern comprising:

an assembly of a plurality of bar-shaped members formed of an evaporative material and a plurality of connecting members formed of an evaporative material;

each connecting member having a spherical shape; and one end of each bar-shaped member being connected to one of the connecting members and another end of each bar-shaped member being connected to another connecting member to form the three-dimensional mesh structure, wherein at least one end of each bar-shaped member expands towards a surface of at least one connecting member.

8. The evaporative pattern of claim 7, wherein a space is preserved between at least one end of each bar-shaped member and the surface of at least one connecting member in response to the at least one end of each bar-shaped member being in contact with the surface of at least one contacting member.

9. The evaporative pattern of claim 8, wherein an adhesive is filled in the space.

* * * * *